US012270202B2

(12) United States Patent
Ryan

(10) Patent No.: US 12,270,202 B2
(45) Date of Patent: Apr. 8, 2025

(54) ROOF DECK

(71) Applicant: Epic Metals Corporation, Rankin, PA (US)

(72) Inventor: Thomas G. Ryan, Ligonier, PA (US)

(73) Assignee: Epic Metals Corporation, Rankin, PA (US)

( * ) Notice: Subject to any disclaimer, the term of this patent is extended or adjusted under 35 U.S.C. 154(b) by 0 days.

(21) Appl. No.: 16/853,149

(22) Filed: Apr. 20, 2020

(65) Prior Publication Data

US 2020/0340247 A1 Oct. 29, 2020

Related U.S. Application Data

(63) Continuation-in-part of application No. 29/712,677, filed on Nov. 11, 2019, now Pat. No. Des. 949,442.

(Continued)

(51) Int. Cl.
*E04C 2/32* (2006.01)
*B21D 22/02* (2006.01)

(Continued)

(52) U.S. Cl.
CPC ..... *E04C 2/322* (2013.01); *B21D 22/02* (2013.01); *E04B 5/10* (2013.01); *E04B 9/0435* (2013.01);

(Continued)

(58) Field of Classification Search
CPC ..... E04B 5/10; E04B 9/0435; E04B 9/0464; E04C 2/08; E04C 2/32; E04C 2/322; E04C 2/324

(Continued)

(56) References Cited

U.S. PATENT DOCUMENTS 1,561,573 A * 11/1925 Henry ..... E04B 2/842 52/383
2,026,278 A * 12/1935 Higley ..... E04B 5/10 52/579

(Continued)

FOREIGN PATENT DOCUMENTS

AT 303334 B * 11/1972 ..... E04B 5/40
AU 2006100842 B4 10/2006

(Continued)

OTHER PUBLICATIONS

Epicore ER5 & ER6.5 Roof Deck Ceiling Systems Catalogue, 2010, Epic Metals Corporation, Rankin, Pennsylvania, USA, pp. 1-12.

(Continued)

*Primary Examiner* — Jessica L Laux
*Assistant Examiner* — Joseph J. Sadlon
(74) *Attorney, Agent, or Firm* — The Webb Law Firm

(57) ABSTRACT

Decking with a panel of uniform thickness sheet metal has a repeating pattern of top flanges and bottom flanges connected by webs therebetween. At least one flange is made up of a plurality of folded-layer segments adjacent to each other in a stacked position to increase the thickness of the flange. Additionally a structural member extending along a longitudinal axis has a uniform thickness plate folded back onto itself about the longitudinal axis or an axis parallel to the longitudinal axis to increase the thickness and provide greater resistance to buckling in response to compressive forces. Such structural members not only provides certain structural advantages but also may provide an aesthetically pleasing appearance.

14 Claims, 12 Drawing Sheets

Related U.S. Application Data

(60) Provisional application No. 62/837,280, filed on Apr. 23, 2019.

(51) Int. Cl.
*E04B 5/10* (2006.01)
*E04B 9/04* (2006.01)
*E04C 2/08* (2006.01)
*E04D 3/30* (2006.01)
*E04F 15/06* (2006.01)

(52) U.S. Cl.
CPC ..... *E04B 9/0464* (2013.01); *E04C 2/08* (2013.01); *E04D 3/30* (2013.01); *E04F 15/06* (2013.01)

(58) Field of Classification Search
USPC ..... 52/588.1
See application file for complete search history.

(56) References Cited

U.S. PATENT DOCUMENTS 2,144,528 A * 1/1939 Ewald ..... E04C 2/427 29/897.15
2,694,475 A * 11/1954 Crafton ..... E04B 5/10 52/503
2,901,062 A * 8/1959 Rice ..... E04B 9/18 52/783.15
2,902,753 A * 9/1959 Schilberg ..... B21D 22/02 29/463
3,031,044 A * 4/1962 James ..... E04D 3/3602 52/794.1
3,102,613 A * 9/1963 Johnston ..... E04B 5/10 105/422
3,168,171 A * 2/1965 Gaare ..... F16B 37/02 52/630
3,230,931 A * 1/1966 Taylor ..... A01K 1/0151 119/529
3,300,935 A * 1/1967 Marchioli ..... E04B 5/06 52/468
3,511,011 A * 5/1970 Gus ..... E04D 3/30 52/489.1
3,520,100 A * 7/1970 Webb ..... E04D 13/0445 52/630
3,638,465 A * 2/1972 Lickliter ..... B21D 47/01 72/181
3,812,636 A 5/1974 Albrecht et al.
3,820,295 A * 6/1974 Folley ..... E04B 1/08 52/270
3,952,461 A * 4/1976 Kinsey ..... E04B 1/08 52/57
3,973,366 A * 8/1976 Balane ..... E04B 5/48 174/487
4,012,873 A * 3/1977 Lindner ..... E04G 15/061 52/99
4,241,146 A * 12/1980 Sivachenko ..... E01D 19/125 428/156
4,267,954 A * 5/1981 Smith ..... B62D 25/2054 72/196
4,392,295 A * 7/1983 Sasai ..... B21D 51/32 413/6
4,453,349 A 6/1984 Ryan
4,453,364 A 6/1984 Ting
4,507,900 A 4/1985 Landis
4,522,005 A * 6/1985 Seaburg ..... E04D 3/362 52/713
4,593,506 A * 6/1986 Hartman ..... E04B 5/48 52/220.4
4,594,826 A * 6/1986 Gray ..... H02G 3/185 52/126.2
4,603,068 A * 7/1986 Hunter ..... E04C 2/40 428/174
4,630,414 A 12/1986 Ting
4,649,684 A * 3/1987 Petree ..... E04D 3/366 52/395
4,676,042 A * 6/1987 Bell, III ..... E04D 3/3602 52/543
4,682,456 A * 7/1987 Hartman ..... E04B 5/48 138/116
4,726,159 A 2/1988 Stohs
4,741,134 A * 5/1988 Stohs ..... H02G 3/283 52/745.13
4,790,112 A * 12/1988 Wang ..... E04D 3/366 D25/138
4,962,622 A 10/1990 Albrecht et al.
4,982,543 A * 1/1991 Boyd ..... E04D 3/365 52/549
5,172,527 A * 12/1992 Ault ..... E04D 13/1643 52/145
5,205,098 A * 4/1993 Landis ..... E04C 3/07 52/336
5,317,846 A 6/1994 Michlovic
5,337,592 A * 8/1994 Paulson ..... B21D 13/04 72/196
5,493,825 A * 2/1996 Gaston ..... E04C 2/54 52/309.1
5,524,409 A * 6/1996 Kaiser ..... E04C 2/08 52/537
5,651,221 A * 7/1997 Golen ..... E06B 9/02 49/464
5,715,644 A * 2/1998 Yasui ..... B21D 47/00 52/784.14
6,139,974 A * 10/2000 Atkinson ..... F28F 13/00 72/379.6
6,330,777 B1 * 12/2001 Padley ..... B21D 47/04 108/51.11
6,357,191 B1 3/2002 Ault et al.
6,408,586 B1 * 6/2002 Deckert ..... B62D 25/2054 29/897.2
6,460,393 B1 * 10/2002 Sundhagen ..... B21D 22/04 52/630
D507,665 S 7/2005 Ryan et al.
D511,580 S 11/2005 Ryan et al.
7,134,249 B2 * 11/2006 Shapiro ..... E04B 9/245 52/592.1
D608,464 S 1/2010 Ryan
D622,417 S 8/2010 Ryan
D623,773 S 9/2010 Ryan
7,854,102 B2 * 12/2010 Zappa ..... B66B 13/30 52/800.1
D648,445 S 11/2011 Ryan
D655,022 S 2/2012 Ryan
D663,045 S 7/2012 Ryan
8,240,095 B1 8/2012 Meyer
8,375,661 B1 * 2/2013 diGirolamo ..... E04B 5/10 52/223.13
D713,554 S 9/2014 Ryan
8,826,603 B2 9/2014 Shield et al.
D721,826 S 1/2015 Ryan
8,925,285 B2 * 1/2015 Brewerton ..... E04B 1/98 52/783.13
D742,549 S 11/2015 Ryan
D750,278 S 2/2016 Bodwell et al.
D768,883 S 10/2016 Wade et al.
D785,209 S 4/2017 Ryan
D795,455 S 8/2017 Ryan
D796,698 S 9/2017 Mendini
9,845,599 B2 * 12/2017 Bogh ..... E04B 5/40
9,863,146 B2 * 1/2018 Bogh ..... E04D 3/30
9,932,736 B2 4/2018 Ryan et al.
D817,519 S 5/2018 Ryan
D831,233 S 10/2018 Anderson et al.
10,087,633 B2 * 10/2018 Kralic ..... E04D 3/362
10,179,360 B2 * 1/2019 Aso ..... B21D 53/88
10,316,519 B2 * 6/2019 Bogh ..... E04C 2/08
10,526,779 B2 * 1/2020 Knudson ..... E04C 2/292
11,180,919 B1 * 11/2021 Nelson, Jr. ..... E04D 3/30
11,548,048 B1 * 1/2023 Starks, Jr. ..... E04D 3/30

(56) References Cited

U.S. PATENT DOCUMENTS

| | | | | |
|---|---|---|---|---|
| 2001/0039767 | A1* | 11/2001 | Castano | E04B 1/3211 52/80.1 |
| 2003/0154679 | A1* | 8/2003 | Swiszcz | E04B 9/045 52/506.07 |
| 2005/0108978 | A1* | 5/2005 | Strickland | E04C 3/07 52/633 |
| 2006/0101761 | A1 | 5/2006 | Miller | |
| 2006/0236519 | A1* | 10/2006 | Ser | B21D 22/02 72/352 |
| 2010/0115881 | A1* | 5/2010 | Inose | B23K 26/348 219/121.64 |
| 2010/0126244 | A1* | 5/2010 | Chien | B21D 22/02 72/350 |
| 2010/0288481 | A1* | 11/2010 | Zobel | B21C 37/151 165/182 |
| 2015/0013241 | A1* | 1/2015 | Pendley | E04D 13/031 52/202 |
| 2015/0013248 | A1* | 1/2015 | Pendley | E04D 13/031 52/200 |
| 2020/0056373 | A1* | 2/2020 | Thomson | E04C 3/292 |

FOREIGN PATENT DOCUMENTS

| | | | | | |
|---|---|---|---|---|---|
| AU | 2006261587 | B2 | | 12/2006 | |
| CA | 1263212 | A | * | 11/1989 | B32B 15/046 |
| DE | 102020116508 | A1 | * | 12/2021 | |
| EP | 0562190 | A1 | * | 9/1993 | E04C 2/08 |
| EP | 1587996 | B1 | | 4/2010 | |
| EP | 3467230 | A1 | * | 4/2019 | E04B 1/86 |
| FR | 1176824 | A | * | 4/1959 | E04D 3/362 |
| FR | 2737429 | A1 | * | 2/1997 | B21D 19/00 |
| GB | 1157084 | A | * | 7/1969 | E04F 3/3605 |
| GB | 1216073 | A | * | 12/1970 | |
| GB | 1343240 | A | * | 1/1974 | E04C 2/322 |
| GB | 2151523 | A | * | 7/1985 | B21D 49/00 |
| GB | 2203181 | A | * | 10/1988 | E04B 1/80 |
| GB | 2316028 | A | * | 2/1998 | B21D 13/04 |
| GB | 2550426 | A | | 11/2017 | |
| KR | 20080068695 | A | * | 7/2008 | B32B 15/18 |
| KR | 20170002154 | U | * | 6/2017 | E04G 11/48 |
| WO | WO-9205327 | A1 | * | 4/1992 | E04B 9/0407 |
| WO | WO-0238885 | A1 | * | 5/2002 | E04B 5/40 |
| WO | WO 2004081312 | A1 | * | 9/2004 | A01G 9/1438 |

OTHER PUBLICATIONS

Schafer, Benjamin W., "Stiffened Elements with Multiple Intermediate Stiffeners and Edge Stiffened Elements with Intermediate Stiffeners", 2002, International Specialty Conference on Cold Formed Steel Structures, 5.

Toris Roof and Floor Deck Ceiling Systems, 2011, Epic Metals Corporation, Rankin, Pennsylvania, USA, pp. 1-20.

* cited by examiner

ROOF DECK

CROSS REFERENCE TO RELATED APPLICATIONS

This application is a continuation-in-part of U.S. Design patent application No. 29/712,677 filed Nov. 11, 2019 and also claims the benefit of U.S. Provisional Application No. 62/837,280 filed Apr. 23, 2019 and hereby incorporates by reference in its entirety the contents of each of these applications. This application also incorporates by reference in its entirety the contents of each United States Patent Nos. D511,580; D608,464; D721,826; and D507,665.

BACKGROUND OF THE INVENTION

Field of the Invention

The present invention relates to structural and architectural members with folded-layered, embedded metal sub-elements that can be used in the design of a metal roof deck, floor deck, and exposed deck/ceiling systems, among other applications.

Description of Related Art

Hot rolled structural and architectural members have the ability to define the thicknesses of elements, such as flanges and webs, for the best optimization of material and to satisfy the desired shape.

Cold formed structural and architectural members are formed from sheet metal of specific thickness whereby all elements are of that thickness. Cold reduction of specific elements of a cold formed member have been explored. This would typically apply to webs in order to optimize material.

In allowable stress design (ASD), optimization of material is when the maximum energy potential ($F_y$) of the material is utilized in the elastic range. When compressive buckling is not a factor, a profile for the cross section of a member would have equal top and bottom flanges and a thinner web, as shown in prior art FIG. 1A. The energy potential $F_{yc}$ at the top flange is equal in magnitude to the energy potential $F_{yt}$ of the bottom flange, resulting in balanced energy potential distribution, as shown in prior art FIG. 1B.

Unfortunately, in metal deck designs, other considerations end up dictating the profile. Concrete volumes, composite interlocking, roof insulation board, acoustics, exposed ceiling appearance, and compressive buckling all can end up dictating the profile. It can be seen in FIG. 2A that there is material 9 horizontally deposited at the neutral axis. This material is not stressed thus rendering it as non-contributory to optimum energy potential.

Many times, these restrictions are overcome by attaching two profiles in a back-to-back configuration with each profile serving to meet certain conditions of the overall design, as shown in prior art FIGS. 2A and 2B. As shown in the side elevational view in FIG. 2A, the profiles have equal top and bottom flanges. A diagram of the energy potential for the back-to-back configuration shows that the energy potential $F_{yc}$ at the top of the structure is equal in magnitude to the energy potential $F_{yc}$ at the bottom of the structure resulting in a balanced energy potential profile, as shown in FIG. 2B. Although, solving particular conditions, this approach adds another aspect of underutilized material at or near the neutral axis as well as creating more process. It should be noted in FIGS. 1A and 2A that the neutral axis N.A., also designated as 10, is located midway between the top flange 2 and the bottom flange 3. Under these circumstances the energy potential distribution is equal in the region above and below the neutral axis, as shown in FIGS. 1B and 2B.

Many roof and floor decks have their underside exposed as a finished ceiling. In general, the aesthetics of a finished ceiling are simple, clean lines with minimum shadow rib effects and basically planar, as shown in prior art FIGS. 3A and 3B. As shown in FIG. 3A, a profile for a finished ceiling roof panel assembly may not have equal top and bottom flanges and the webs could incline towards each other from the top flange to the bottom flange, as shown in FIG. 3A. Unfortunately, this results in a very unbalanced profile meaning poor utilization of material. With the neutral axis close to the bottom flange, only the smaller top flange utilizes the maximum available energy of the material $F_{yc}$ and the larger bottom flange only utilizes a fraction of the energy $F_{yt}$ resulting in an unbalanced energy potential profile as shown in the diagram of the energy potential shown in FIG. 3B. This is based on the assumption that compressive buckling is not a factor and the full width of the flanges are effective.

Accordingly, there has been a need to optimize the strength of a profile and provide a balanced energy potential for structural and architectural members that can be used in the design of a metal roof deck, floor deck, and exposed deck/ceiling systems, among other applications.

SUMMARY OF THE INVENTION

The present invention is based on a unitary or single skin design of structural and architectural members with the various restrictions solved by folded-layered, embedded sub-elements. Folded-layered, embedded segments, also called sub-elements, which are cold formed from sheet metal as an integral part of the profile forming process, provide a great flexible design tool for optimizing material for improved structural characteristics and the freedom to create specific profile designs from a unitary or single skin piece of metal for use as structural and architectural members.

Specifically, the decking can be made from a unitary piece of steel sheet that is sufficiently strong and does not have to be made of multiple pieces and incorporate welding or other means of fastening. As a result, the unitary pieces can be painted and treated prior to bending, which substantially reduces costs. Essentially, the rib and flange arrangement is bent through multiple processes through a die, so that the flanges and ends are multi-layers thick. Essentially, the flanges must be either two, three, and maybe even five layers thick while the ends of the decking are reversed and two layers thick, resulting in connected decking having a three-layer thickness, which substantially increases the strength of the deck from the prior art, which is one layer thick.

The use of folded-layered, embedded sub-elements in structural and architectural members can solve the problem of an unbalanced energy profile, where the top flange utilizes the maximum available energy of the material, and the larger bottom flange only utilizes a fraction of the energy by adding material to the top flange to match the desired bottom flange. Folded-layered, embedded elements may be added to the top flange, resulting in a balanced energy profile. The condition for top flange side laps can be solved with folded-layered, embedded sub-elements, but in a slightly different configuration.

In addition to solving the problem of an unbalanced energy profile, the use of folded-layered, embedded sub-elements for flanges and other elements in structural and architectural members increases the total thickness of the flange or other element, consolidates the width of the flange or other element, and stiffens the flange or other element. The use of folded-layered, embedded sub-elements also assists in optimizing the strength of a profile, optimizing the proportions of a profile, and allowing a profile to be designed from a unitary piece of metal.

Other benefits of the use of folded-layered, embedded sub-elements in structural and architectural members include that they allow reverse nestable packaging and appealing finished ceilings as the underside of a metal deck. The use of folded-layered, embedded sub-elements also improves distortional buckling, provides mechanical interlocking with concrete for metal deck floors, and allows for widening flanges on metal decks.

One embodiment of the subject invention is directed to decking comprising a panel of uniform thickness sheet metal having a repeating pattern of top flanges and bottom flanges connected by webs therebetween, wherein at least one flange is comprised of a plurality of folded-layer segments adjacent to each other in a stacked position to increase the thickness of the flange and a method for making the same as shown for example, but not limited to, FIG. 4A.

Another embodiment of the subject invention is directed to a structural member extending along a longitudinal axis comprising a uniform thickness plate folded back onto itself about the longitudinal axis or an axis parallel to the longitudinal axis to provide greater resistance to buckling in response to compressive forces and a method for forming the same as shown for example, but not limited to, FIG. 15.

DESCRIPTION OF THE PREFERRED EMBODIMENTS

Figure 1B:
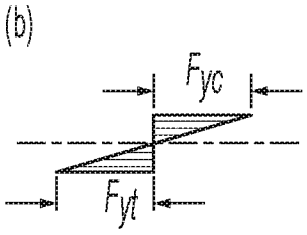
FIG. 1B PRIOR ART
FIG. 1B is prior art and is an illustration of the energy potential profile associated with the structure in FIG. 1A.
Figure 1A:
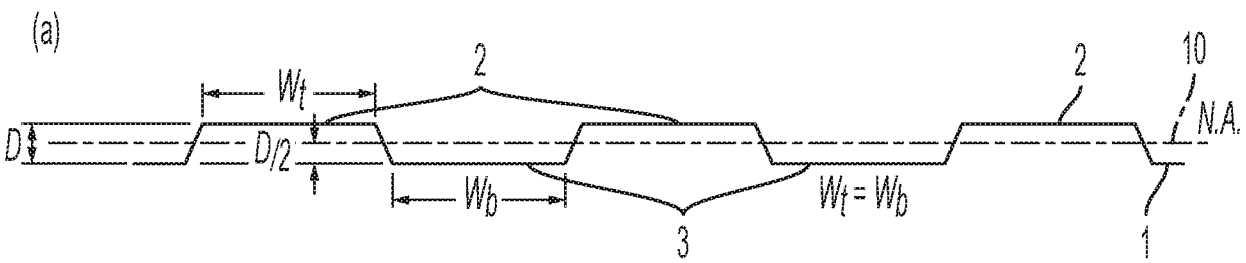
FIG. 1A PRIOR ART
FIG. 1A is prior art and is a side elevational view of a conventional structural or architectural member.
Figure 2B:
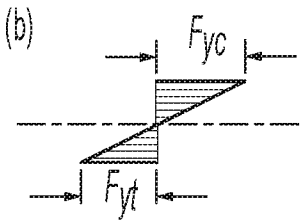
FIG. 2B PRIOR ART
FIG. 2B is prior art and is an illustration of the energy potential profile associated with the structure in FIG. 2A.
Figure 2A:
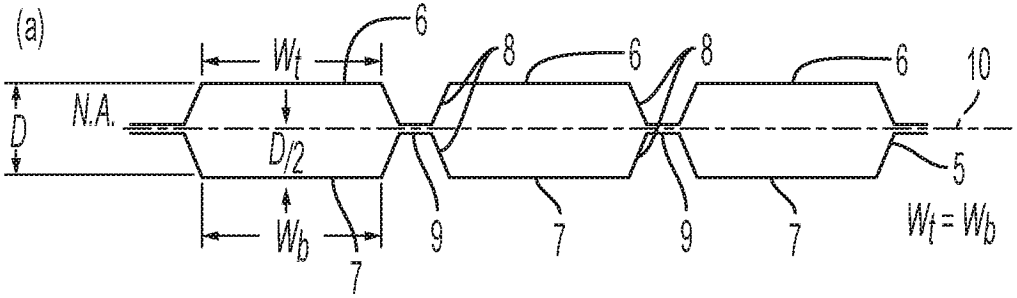
FIG. 2A PRIOR ART
FIG. 2A is prior art and is a side elevational view of the profile for a back-to-back configuration for a structural or architectural member.

FIG. 1A is a side elevational view showing one embodiment of a metal roof deck 1 having top flanges 2 equal in width to the bottom flanges 3 and a thinner web 4 extending on an incline from the top flanges 2 to the bottom flanges 3. FIG. 2A shows a side elevational view of another embodiment of a metal roof deck 5 that is comprised of two profiles, as shown in FIG. 1A in a back-to-back configuration for which the top flange 6 is equal in width to the bottom flange 7 and the webs 8 are inclined towards a centerline connecting flange 9. The top flange 6 and bottom flange 7 are arranged to be an equal distance from the centerline or neutral axis 10. As shown in FIG. 1B, the configuration shown in FIG. 1A results in a balanced maximum energy potential profile. As shown in FIG. 2B, the configuration shown in FIG. 2A results in a balanced maximum energy potential profile but adds additional underutilized material at or near the neutral axis 10 as well as creating more processing. Examples of these types of prior art decking are found in U.S. Pat. Nos. D511,580; D608,464; D721,826; and D507,665.

Figure 3A:
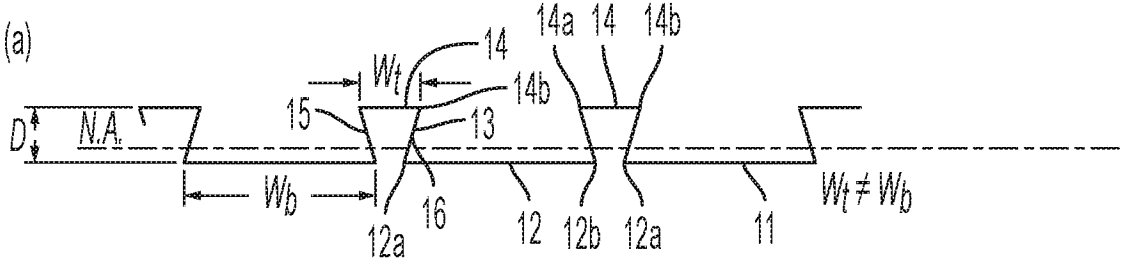
FIG. 3A PRIOR ART
FIG. 3A is prior art and is a side elevational view of a structural or architectural member for a finished ceiling in one embodiment of the subject invention.
Figure 3B:
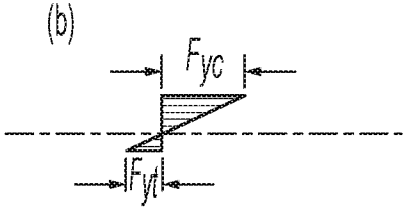
FIG. 3B PRIOR ART
FIG. 3B is prior art and is an illustration of the energy potential profile associated with the structure in FIG. 3A.

FIG. 3A is prior art and shows a cross section profile of a finished ceiling roof deck panel 11 with a flat bottom flange 12 and a rib 13 comprising a top flange 14 and two diverging webs or side walls 15, 16 that connect the top flange 14 to the bottom flange 12. The top flange 14 is not equal in width to the bottom flange 12, but rather typically the top flange 14 has a smaller width than the bottom flange 12. As shown in FIG. 3B, the configuration results in an unbalanced maximum energy potential profile. Overall, the panel 11 is made up of a series of adjacent top flanges 14 and a series of adjacent bottom flanges 12. Each top flange 14 has a first end 14*a* and a second end 14*b*. Each bottom flange 12 has a first end 12*a* and a second end 12*b*. The first end 12*a* of the one bottom flange 12 is connected to the second end 14*b* of one top flange 14 and the second end 12*b* of the bottom flange 12 is connected to the first end 12*a* of a different top flange 12.

Figure 4A:
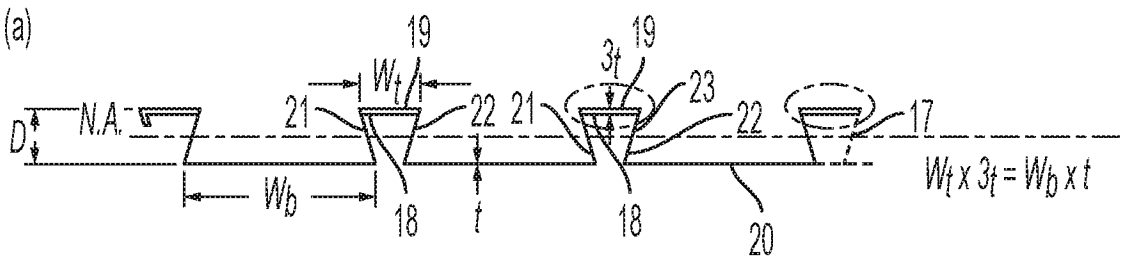
FIG. 4A is a side elevational view of a structural or architectural member with folded-layered, embedded elements added to the top flange, according to one embodiment of the invention.
Figure 4B:
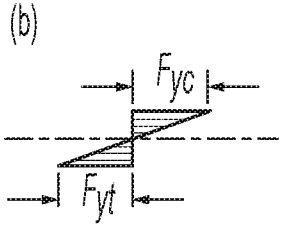
FIG. 4B is an illustration of the energy potential profile associated with the structure in FIG. 4A.

In one preferred embodiment of a structural and architectural member for a finished ceiling roof deck panel 17, according to the present invention, depicted in FIG. 4A, folded-layered, sub-elements, or segments 18 are added to the top flange 19. In this embodiment, the finished ceiling roof deck panel 17 comprises a flat bottom flange 20 and a rib 23 comprising the top flange 19 and two diverging webs or side walls 21, 22 that connect the top flange 19 to the bottom flange 20. The top flange 19 is not equal in width to the bottom flange 20. Using folded-layered, embedded sub-elements, or segments 18 in this preferred embodiment can triple the thickness of the top flange 19 as compared to the thickness of the bottom flanges 20 and the side walls 21, 22. As shown in the energy potential profile of FIG. 4B, this can result in a balanced profile with the maximum energy potential $F_{yc}$ for the top flange 19 being equal in magnitude to the maximum energy potential $F_{yt}$ for the bottom flange 20.

Worded differently, the panel 17 is made up of uniform thickness sheet metal having a repeating pattern of top flanges 19 and bottom flanges 20 connected by webs 21, 22 therebetween. At least one flange 21 is comprised of a plurality of folded-layer segments 18 adjacent to each other in a stacked position to increase the thickness of the flange 21. As illustrated in FIG. 4A, the top flanges 19 and the bottom flanges 20 may be parallel to one another.

Figure 4C:
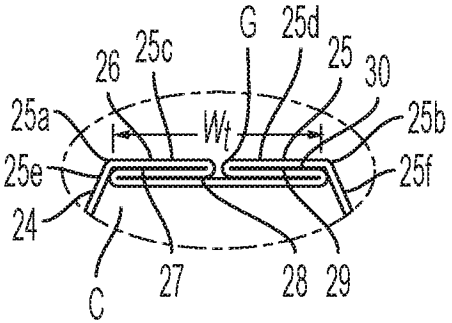
FIG. 4C is a detailed side elevational view of the top flange of a structural or architectural member with folded-layered, embedded elements, according to one embodiment of the invention.

FIG. 4C depicts one preferred embodiment of the top flange 25 for the folded-layered, embedded elements 26, 27, 28, 29, 30 comprising the top flange 19. In this preferred embodiment, a plurality of folds are made to the sheet metal 24 to construct a top flange 19 comprising a plurality of folded-layered, embedded elements 26, 27, 28, 29, 30. In this preferred embodiment, four of the folded-layered, embedded elements 26, 27, 29, 30 are of equal Wt/2 or nearly equal width Wt/2 and a fifth folded-layered, embedded element 28 is twice or nearly twice the width of each of the other folded-layered, embedded elements 26, 27, 29, 30. The folded-layered, embedded elements 26, 27, 28, 29, 30 are constructed by bending and folding the sheet metal 24 used to construct the roof deck panel, floor panel, or other structural member. In this embodiment, the thickness of the top flange 19 is tripled as three folded-layered, embedded elements 26, 27, 28 and 28, 29, 30 are folded or stacked to form three layers in which each layer has the same thickness as the sheet metal 24. Worded differently, at least one flange 25 is folded from each end 25*a*, 25*b* to make up multiple folds defining two separate spaced-apart switch-back configurations 25*c*, 25*d* with a gap G therebetween providing a three deep layer flange. In FIG. 4C, the gap G is facing outwardly from a cavity C defined by the flange 25 and adjacent webs 25*e*, 25*f*. While not illustrated, it is obvious to one skilled in the art that the gap G may also be facing inwardly from a cavity C defined by the flange 25 and the webs 25*e*, 25*f*.

Also apparent in FIG. 4C, the flange 25 has a width W1 equal to the spacing of the webs 25*e*, 25*f* at their attachment to the flange 25.

Figure 4D:
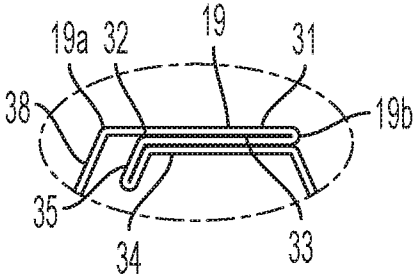
FIG. 4D a detailed side elevational view of the top flange of a structural and architectural member with folded-layered, embedded elements, according to one embodiment of the invention.

FIG. 4D depicts one preferred embodiment 31 for the folded-layered, embedded elements 32, 33, 34 used in the top flange 19 that form a sheet to sheet lap on the top flange. In this embodiment, the sheet metal is folded to construct three approximately equal width layered sub-elements 32, 33, 34 that include one top sub-element 32 that is the width of the top flange 19 layered on top of two sub-elements 33, 34 that are approximately the length of the top flange 19 but with one folded edge 35 folded down away from the top sub-element 32 so as to be positioned under the top sub-element 32 and generally conform to the shape of the side wall or web 38 at its intersection with the top sub-element 32 of the top flange 19. In FIG. 4D, the top flange 19 is folded from each flange end 19*a*, 19*b* to make up a single switch-back configuration providing a three deep layer flange 19. Each layer, or sub-element 33, 34 is parallel to the other layer 33, 34 over a portion of the width and a remaining portion 35 is bent out of plane for additional stiffness. However, it is entirely possible for each layer 33, 34 to be parallel to the other over the entire width of the flange 19.

Another way of describing this solution is visualizing the attached back-to-back profile 5 as described in FIG. 2A where the wide single layer top flange 6 is converted to a narrow folded multiple layer flange of the same equivalent developed width.

Profiles that have large width-to-thickness ratios (w/t) are subjective to compressive buckling which results in a reduced effective width of elements. The use of folded-layered, embedded elements can improve the effective width. Referring to FIG. 1A, the wide top flange 2 of the profile in a light gage could be only partially effective, even considering the use of an intermediate stiffener.

Figure 5B:
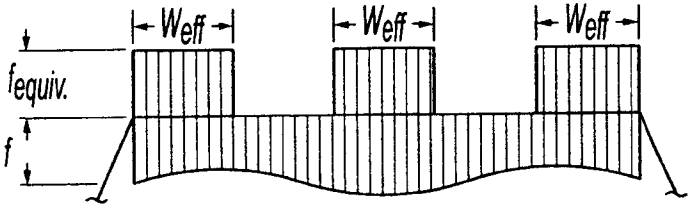
FIG. 5B is a diagram of the stress distribution for the flange subject to local buckling depicted in FIG. 5A.
Figure 5D:
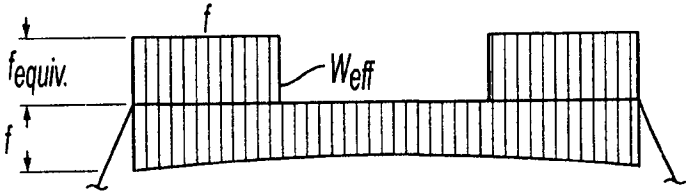
FIG. 5D is a diagram of the stress distribution on the flange subject to distortional buckling depicted in FIG. 5C.
Figure 5A:
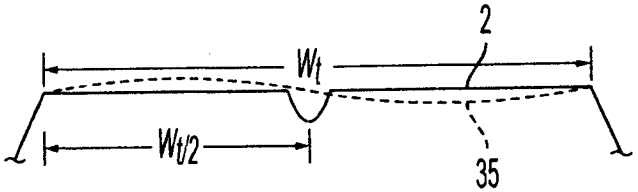
FIG. 5A is a side elevational view of a flange subject to local buckling.
Figure 5C:
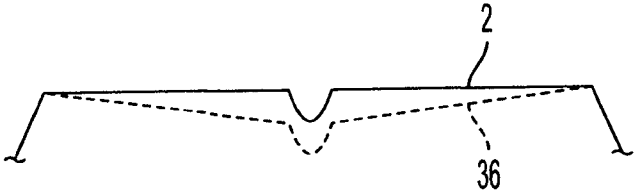
FIG. 5C is side elevational view of a flange subject to distortional buckling.

FIGS. 5A-5D illustrate the compressive buckling modes for the conventional wide flange profile 1 shown in FIG. 1A. FIG. 5A shows local buckling of the wide top flange 2, with the dotted line 35 representing the shape of the wide top flange 2 subject to local buckling. FIG. 5C shows distortional buckling, with the dotted line 36 representing the shape of the wide top flange 2 subject to distortional buckling. FIG. 5B shows the stress distribution on the flange 2 subject to local buckling. FIG. 5D shows the stress distribution on the flange 2 subject to distortional buckling. The expression of flange stiffness is the product of $wt^3$ for the flange 2, where w is the width of the flange and t is the thickness of the flange.

Figure 6B:
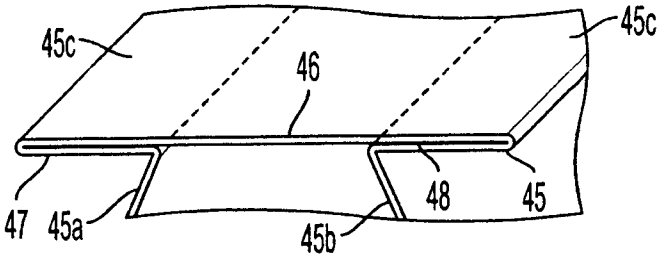
FIG. 6B is a top prospective view of an embodiment of the subject invention showing a folded-layer flange with two folded layers.
Figure 6A:
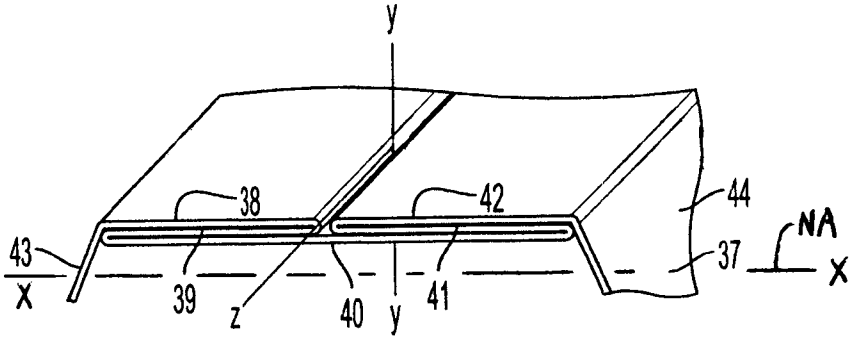
FIG. 6A is a top prospective view of an embodiment of the subject invention showing a folded-layer flange with three folded layers.
Figure 9:
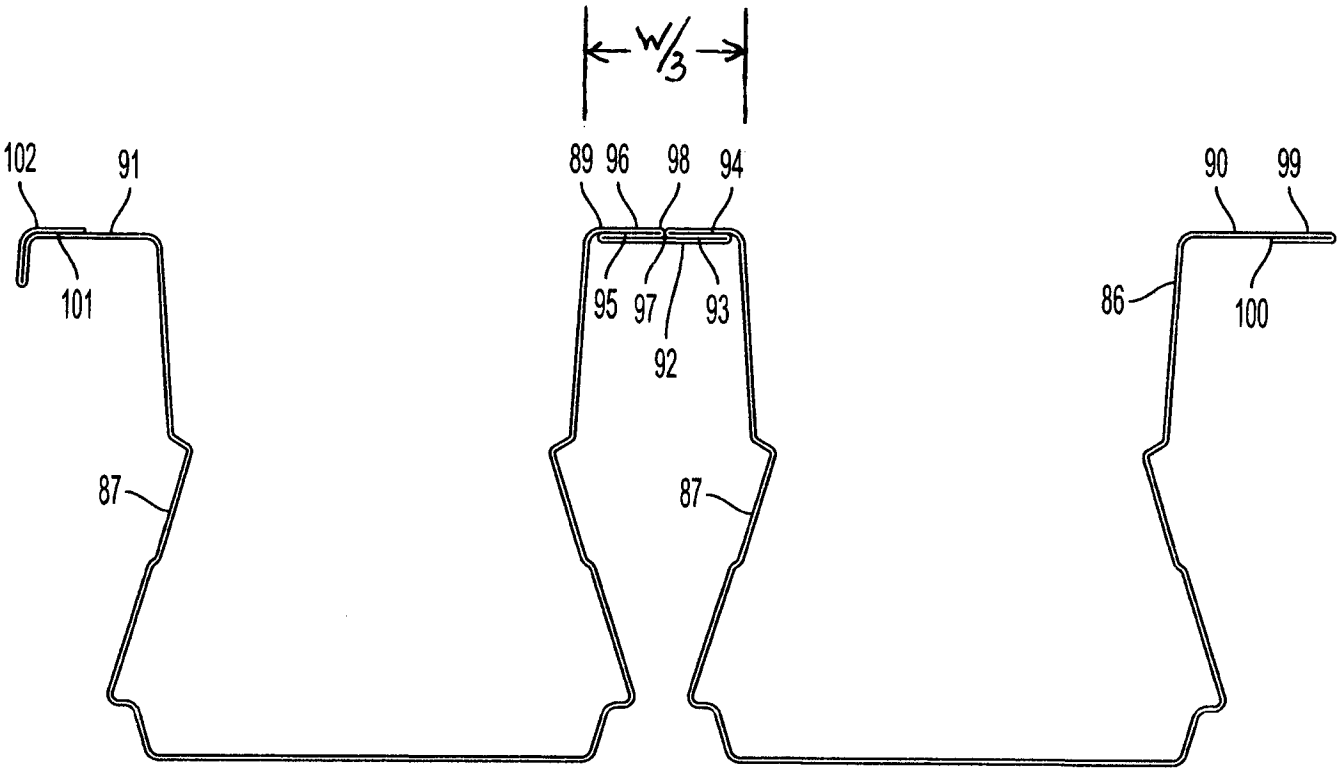
FIG. 9 is a side elevational view of the subject invention showing a structural member employing folded-layers in top flanges.

FIGS. 6A and 6B show two additional alternative embodiments of a folded-layer flange in accordance with the present invention. In FIG. 6A, the flange 37 is comprised of a plurality of folded sub-elements 38, 39, 40, 41, 42 wherein a metal sheet forming a first side wall or web 43 is folded to create sub-element 38, folded back again to create sub-element 39, and folded a third time to create sub-element 40. Sub-element 40 is, in turn, folded back again to form sub-element 41, and sub-element 41 is folded back again to create sub-element 42 which, in turn, is folded to create side-wall 44. In this configuration, sub-elements 38 and 42 form the top surface of flange 37 and sub-element 40 forms the bottom surface of flange 37. The expression for flange stiffness is the product of $(w)\times(3t)^3$ for the folded-layered flanges shown in FIG. 6A, again where w is the overall width of the flange and t is the thickness of each sub-layer. The folded-layered flange 37 in FIG. 6A is simply $(3)^3$ or 27 times stiffer than the wide flange 2 of FIG. 1A and is equal in stiffness about the longitudinal axis (x axis) as well as the transverse axis (z axis). Overall, the flanges 2 and 6 having widths of $W_t$ in FIGS. 1A and 2A are not fully effective. On the other hand, this folded-layered configuration is very beneficial for top flanges in compression (positive bending). Based upon the ability to increase the stiffness of the flange by folding, it is also possible to reduce the width of the flange and at the same time provide such improved stiffness. Briefly directing attention to FIG. 9, the width (W/3) of the flange 89 may be ⅓ of the width $W_t$ of the flange 2 in FIG. 1A or of the flange 6 in FIG. 2A and still be significantly stiffer. In particular, the flange 89 in FIG. 9 is nine (9) times stiffer, the product of $(w/3)\times(3t)^3$, and is stiff enough to insure that the flange 89 is fully effective. FIG. 6B illustrates another version of the folded-layered flange 45 which comprises only two folded-layers 46 and 47, 48 with a thickness of 2t where sub-layers 47 and 48 abut sub-layer 46 along the width of the flange 45. Such a folded-layer flange 45 would have lesser structural resistance than the flange of FIG. 6A, but greater structural resistance than the flange 2 of FIGS. 1A, 5A, and 5C. Worded differently, FIG. 6A illustrates a flange 45 has a width greater than the spacing of the webs 45*a*, 45*b* at their attachment to the flange 45 thereby defining a flange overhang 45*c* which is folded back upon itself to provide a two deep layer flange 45.

Figure 7E:
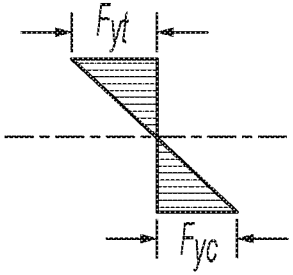
FIG. 7E is an illustration of the energy potential profile associated with the structure in FIG. 7A wherein the bottom flange is only partially effective due to local or distortional compressive buckling.
Figure 7A:
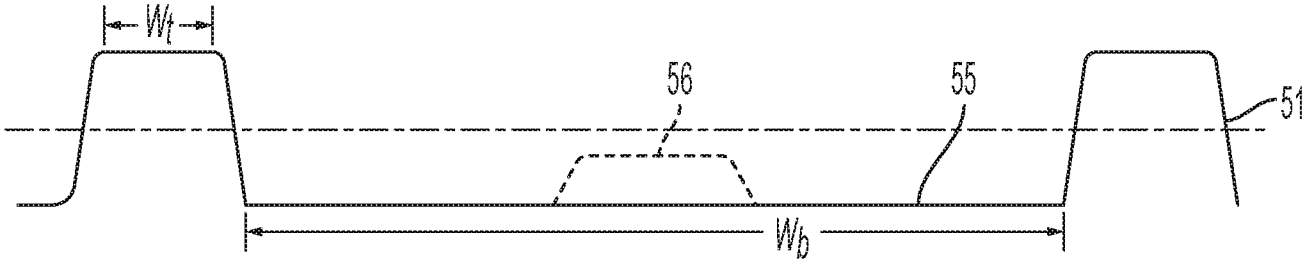
FIG. 7A PRIOR ART
FIG. 7A is prior art and is a side elevational view showing a roof deck panel including a longitudinal stiffener.
Figure 7D:
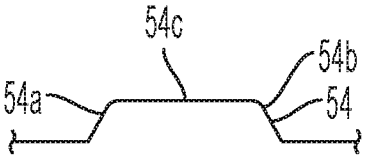
FIG. 7D PRIOR ART
FIG. 7D is prior art and is a side elevational view showing a third configuration of a longitudinal stiffener.
Figure 7C:
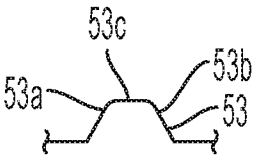
FIG. 7C PRIOR ART
FIG. 7C is prior art and is a side elevational view showing a second configuration of a longitudinal stiffener.
Figure 7B:
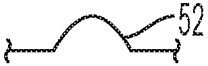
FIG. 7B PRIOR ART
FIG. 7B is prior art and is a side elevational view showing one configuration of a longitudinal stiffener.

On the ceiling or exposed side of a roof deck panel 51 which is subject to compressive buckling and negative bending as shown in prior art FIG. 7A, a longitudinal stiffener 56 can be employed in the center section of the flange 55 to increase the effective width of the flange 55. Prior art FIG. 7B shows a side elevational view of one profile for the stiffener 56. The stiffener is in the form of a protrusion 52 with a curved profile. Prior art FIG. 7C shows a side elevational view of a second profile 53 for the stiffener 56. The stiffener is in the form of a protrusion 53 with having opposing ramped sides 53*a*, 53*b* connected by a flat end 53*c*. Prior art FIG. 7D shows a side elevational view of a third configuration for profile 54 for the stiffener 56. The stiffener is in the form of a protrusion 54 having opposing ramped sides 54*a*, 54*b* connected by a flat end 54*c*

Since the objective of an exposed ceiling is simplicity, to remain planar, and exhibit a minimum of shadow lines for the best aesthetics, the use of a stiffener 56 having one of the profiles 52, 53, 54 is usually, but not always, ruled out. FIG. 7E is an illustration of the energy potential profile associated with the structure in FIG. 7A showing that the energy potential can be balanced through the use of a stiffener.

Figure 8A:
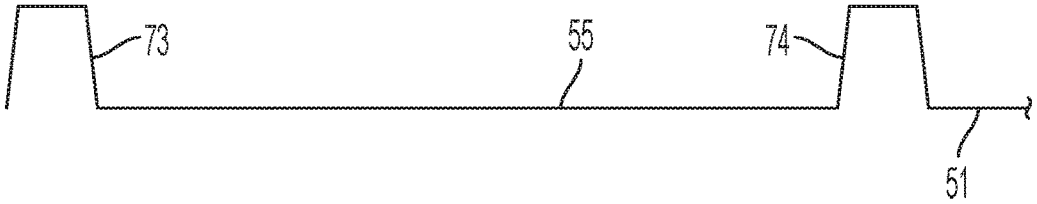
FIG. 8A is a side elevational view of the subject invention showing a roof deck panel.
Figure 8B:
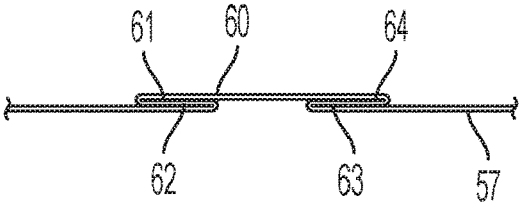
FIG. 8B is a side elevational view of the subject invention showing one embodiment of a folded-layer stiffener that can be used for the roof deck panel of FIG. 8A.
Figure 8C:
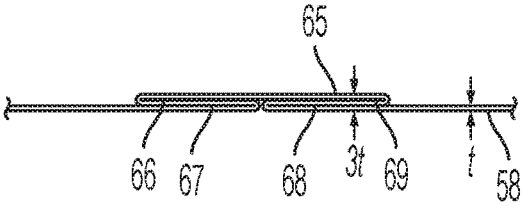
FIG. 8C is a side elevational view of the subject invention showing one embodiment of a folded-layer stiffener that can be used for the roof deck panel of FIG. 8A.

If folded-layered stiffeners are employed instead of the profiles 52, 53, 54 configured as shown in prior art FIGS. 7A-D, the structural benefit of a stiffener can be gained without destroying the aesthetics of the ceiling. As shown in FIGS. 8B-8D, folded layer stiffeners 57, 58, 59 can be used in conjunction with the flange 55 of a roof deck panel 51 shown in FIG. 8A. Folded-layered stiffeners are of the same concept as a folded-layered flange but of various proportions which create sub-elements. In FIG. 8B, folded-layer stiffener 57 is comprised of folded-layer sub-elements 60, 61, 62, 63, 64 which are substituted for the mid-portion of the flange 55 of roof deck panel 51 as depicted in FIG. 8A. Folded-layer stiffener 57 has a thickness of 3t, where t is the thickness of the flange 55, at the two end areas of the stiffener 57 where sub-elements 60, 61, 62 and 60, 63, 64 are folded and stacked together but only a thickness of tin the middle portion of sub-element 60.

In FIG. 8C, folded-layer stiffener 58 is comprised of folded-layer sub-elements 65, 66, 67, 68, 69 which are substituted for the mid-portion of the flange 55 of roof deck panel 51 as depicted in FIG. 8A. Folded-layer stiffener 58 has a thickness of 3t, where t is the thickness of the flange 55, along its entire width as sub-elements 66, 67, 68, 69 are folded underneath top sub-element 65, which also spans the entire width of the stiffener 58, and stacked together in a vertical arrangement.

In FIG. 8D, folded-layer stiffener 59 is comprised of folded-layer sub-elements 75, 76, 77, 78, 79 which are substituted for the mid-portion of the flange 55 of roof deck panel 51 as depicted in FIG. 8A and the bottom portions of side walls 73, 74. Folded-layer stiffener 59 has a thickness of 3t, where t is the thickness of the flange 55, at its two end portions where sub-elements 75, 76, 77 and 75, 78, 79 are folded and stacked together in a vertical arrangement and connect to the side walls 73, 74. The middle portion of the folded-layer stiffener 59 comprising a portion of sub-element 75 has thickness of t.

Figure 8E:
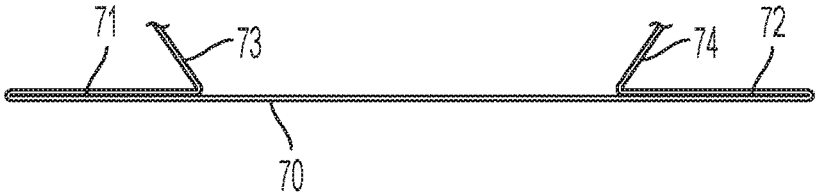
FIG. 8E is a side elevational view of the subject invention showing one embodiment of a folded-layer stiffener that can be used for the roof deck panel of FIG. 8A.
Figure 8D:
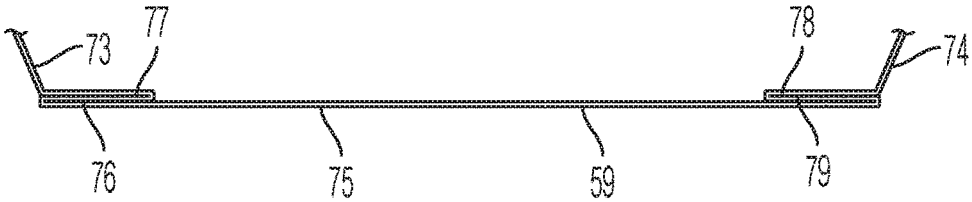
FIG. 8D is a side elevational view of the subject invention showing one embodiment of a folded-layer stiffener that can be used for the roof deck panel of FIG. 8A.
Figure 8F:
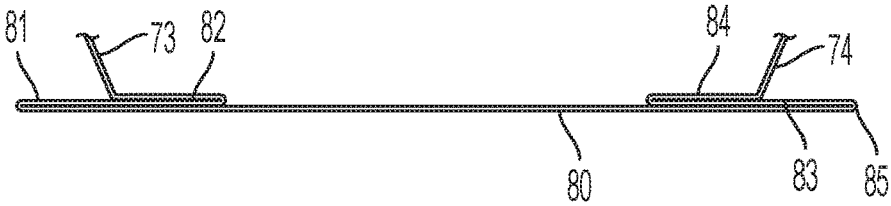
FIG. 8F is a side elevational view of the subject invention showing one embodiment of a folded-layer stiffener that can be used for the roof deck panel of FIG. 8A.

FIG. 8E is similar to FIG. 6B which has less structural potential since it is of two thicknesses (2t) at its ends where sub-elements 71 and 72 are folded and stacked on top of sub-element 70. Sub-element 70 also extends underneath the side walls or webs 73, 74. FIG. 8F is a hybrid of the two and three thickness designs wherein sub-element 80 spans the entire width of the stiffener and sub-elements 81, 83 are folded and stacked on top of the ends of sub-element 80 such that the two ends of the stiffener 85 located under the inclined side walls 73, 74 have a thickness of 2t. Two portions of the folded-layer stiffener 85 extending the length of sub-elements 82, 84 from the side walls 73, 74, respectively, towards the center of the stiffener 85 give the stiffener a thickness of 3t where sub-elements 80, 81, 82 are stacked together in a vertical arrangement and sub-elements 80, 83, 85 are stacked together in a vertical arrangement. Combinations of these stiffeners can be employed in a particular design.

Although these stiffeners have limited depth potential as a function of multiple thicknesses, they are effective in bending both the "X" and "Z" axes. Traditional open stiffeners, as shown in prior art FIGS. 7A-7D, are beneficial about the "X" axis (local buckling) but reduce capacity about the "Z" axis (distortional buckling), as shown in FIGS. 5A-5D. Since the majority of the structural failure modes are distortional, buckling rather than local buckling, the folded-layered stiffeners, as shown in FIGS. 8B-8F solve the structural capacity issue while maintaining the desired aesthetics.

The structural aspect can be best explained by assuming both the folded-layered stiffener (closed) and the traditional stiffener (open) utilize the same amount of material. The open stiffener would be stronger about the "X" axis simply because of the depth possibilities. It is weaker about the "Z" axis because the additional material of the stiffener is added to the flexural width of the overall flange increasing earlier distortional buckling.

The folded-layered stiffener (closed) adds nothing to the flexural width of the flange but in fact stiffens the flange about the "Z" axis, thus, increasing the limit of distortional buckling. The relationship can be best explained as a ratio of "X/Z". For the open stiffener, this ratio is:

$$\frac{(I_f + I_s)x}{(W_f + W_s)z}$$

Where:

$I_s$=moment of inertia of stiffener.

$I_f$=moment of inertia of compression flange.

$W_s$=developed width of stiffener.

$W_f$=width of compression flange

For the folded-layered stiffener, this ratio using the same defined variables is:

$$\frac{(I_f + I_s)x}{(W_f - W_s)z}$$

Figure 16:
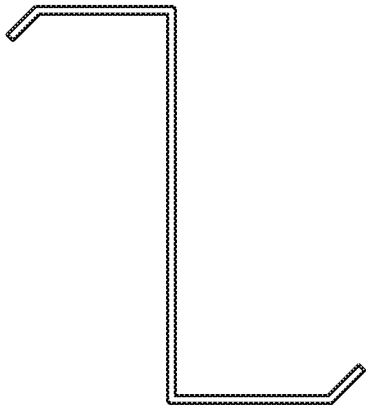
FIG. 16 is a side elevational view of a C-shaped purlin or girt.
Figure 17:
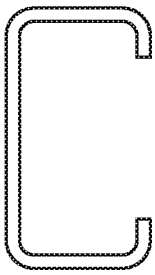
FIG. 17 is a side elevational view of a Z-shaped purlin or girt.

Likewise, there is a third axis of structural concern. This axis ("Y") is of most concern in framing members such as C-shaped and Z-shaped purlins and girts, and the hat-shaped deck elements shown herein, but that do not have a repeating pattern. It is also meaningful relative to deck diaphragm flexure and would follow the same relationships as described in paragraphs [0068]-[0070] but switching the "Y" and "Z" axes. In other words, the geometry modifications discussed herein for strengthening the hat-shaped structural elements may also be applied to other elements such as the C-shaped element illustrated in FIG. 16 and the Z-shaped element illustrated in FIG. 17. These elements are generally used spaced apart from one another and are not connected adjacent to one another as are some of the hat-shaped elements.

As shown in FIG. 9, a structural or architectural member 86 that can be employed as a roof deck panel or a ceiling panel, among other applications, comprises two rib members 87 connected by a top flange 89 in the central portion of the member 86 and having top flanges 90, 91 at the ends of the member 86. The top flanges 89, 90, 91 all employ folded-layer sub-elements to stiffen the flanges and the member to reduce distortional buckling as well as balance the top and bottom flanges for optimum metal use. The top flange 89 is comprised of five folded-layer sub-elements 92, 93, 94, 95, 96 formed by bending and folding the sheet metal used in the member 86 four times so as to triple the thickness of the top flange 89 as compared to the thickness of the portions of the member that comprise a single sheet of metal. Sub-element 92 spans the width of the top flange 89 and is arranged vertically below sub-elements 93, 94 which are in turn arranged vertically below sub-elements 95, 96. Sub-elements 93, 94, 95, 96 are of approximately equal width and thickness whereas sub-element 92 is of equal thickness but twice the width of sub-elements 93, 94, 95, 96. Sub-elements 93, 94, 95, 96 are arranged such that one of each of their folded ends 97, 98 is positioned adjacent to each other at the centerline of the top flange 89 and sub-element 92.

The outer flanges 90, 91 of the member 86 may also employ folded-layer sub-elements 99, 100, 101, 102 to increase the stiffness of the member 86 at its free ends as well as balance the top and bottom flanges for optimum metal use. Top flange 89 can be configured to employ double-layer folded sub-elements 99, 100 with sub-element 100 folded so as to be stacked vertically underneath or below sub-element 99. Top flange 89 may also employ double-layer folded sub-elements 101, 102 with sub-element 102 folded so as to be stacked vertically above or on top of sub-element 101 and the folded-layers 101, 102 can be further bent or partially folded in a direction substantially perpendicular to the surface of the top flange 89. Worded differently, the top flange 90 may employ double-folded elements 99, 100. The top flange 91 may employ double-folded elements 101, 102 which can be further bent or partially folded in a direction substantially perpendicular to the surface of the top flange 91. In this fashion, an end of the member 86, for example top flange 90, may be placed over and interlocked with an opposite end of a similar member, for example 91, to connect two adjacent members. Therefore, one of the outermost flanges 90 has double-folded elements on one side of the flange 91 and another of the outermost flanges 91 has double folded elements on an opposite side of the flange such that the opposing sides of two identical panels may be interlockably mated with one another.

Figure 10:
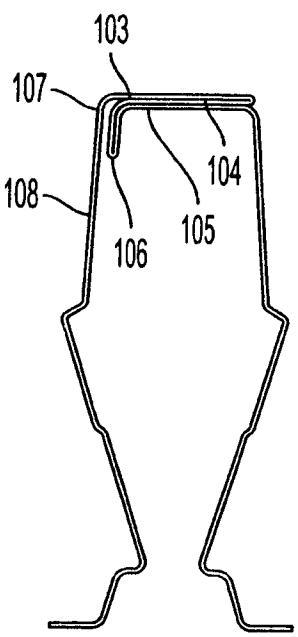
FIG. 10 is a side elevational view of the subject invention showing ends of two adjacent structural members shown in FIG. 9 connected to each other.

An alternate embodiment of the top flange 107 of a structural or architectural member 86 is shown in FIG. 10. The top flange 107 can comprise folded-layer sub-members 103, 104, 105 folded and stacked vertically to triple the thickness of the top flange 107. In this configuration, the sheet metal of sub-element 103 is folded to create sub-element 104 that is then stacked vertically below sub-element 103. Sub-element 104 is, in turn, folded to create sub-element 105 which is, in turn, stacked vertically below sub-element 104. One end 106 of the sub-elements 104, 105 is further bent or folded to extend in the vertical direction parallel and adjacent side wall 108.

Figure 11:
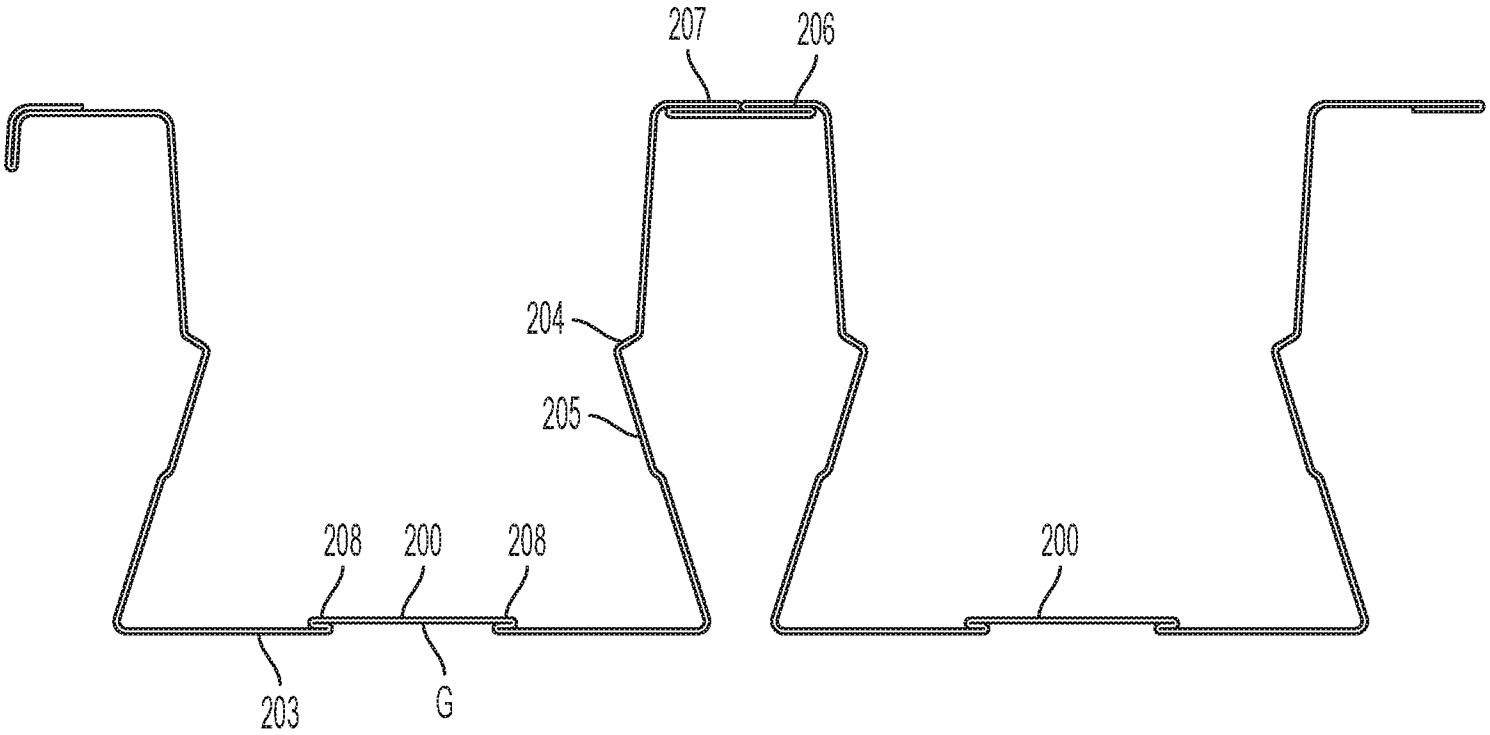
FIG. 11 is another embodiment side elevational view of the subject invention showing a structural member employing folded layers in bottom flanges similar to the embodiment shown in FIGS. 9 and 10.
Figure 12:
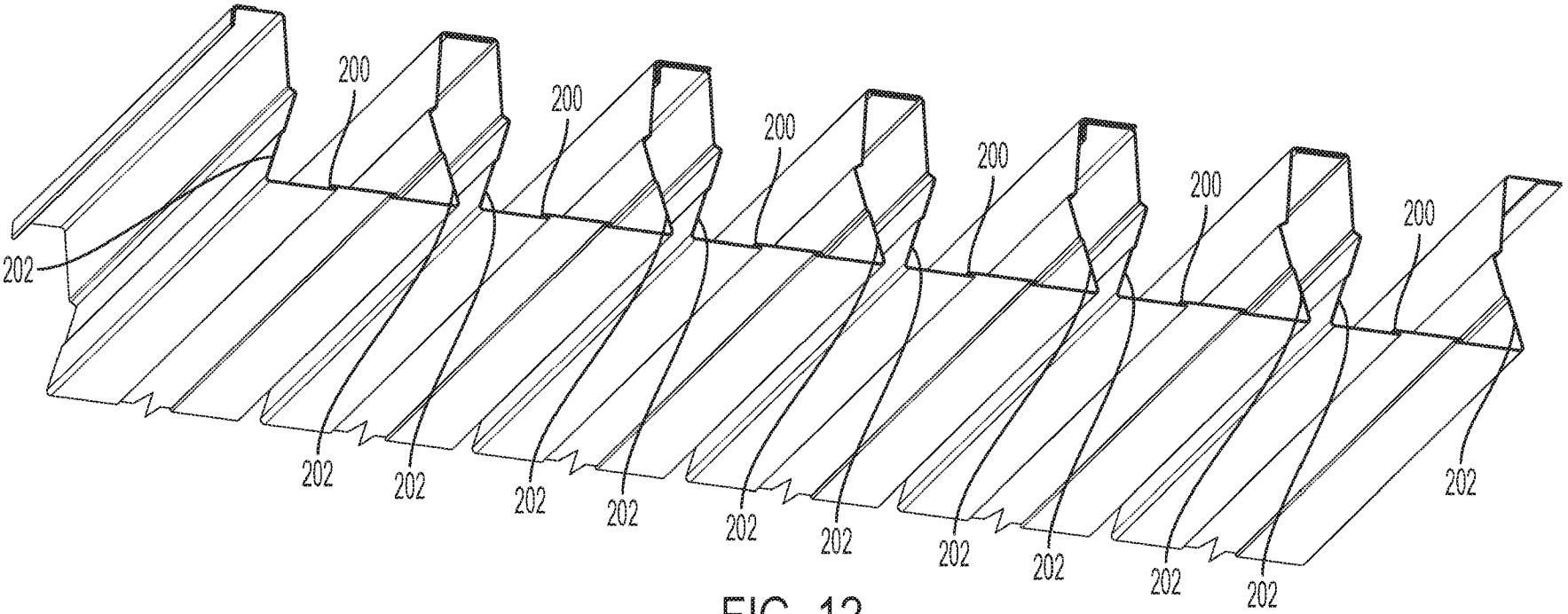
FIG. 12 is a perspective view of the subject invention showing a plurality of structural members shown in FIG. 11 adjacent to and connected to each other.

A further alternate arrangement is shown in FIGS. 11 and 12 which is similar to FIGS. 9 and 10 except for folded section 200 and side profile shape 202.

The panel in FIG. 11 is made up of uniform thickness sheet metal having a repeating pattern of top flanges 207 and bottom flanges 203 connected by webs 205 therebetween. At least one flange 203 is comprised of a plurality of folded sub-elements 200 adjacent to each other in a stacked position to increase the thickness of the flange 203. The flange 203 is folded to make up multiple folds defining two separate spaced-apart switch-back configurations 208 with a gap G therebetween providing a portion of the flange with a three deep layer.

It should be noted that FIG. 11 highlights a combination of folded sub-elements 206 in the bottom flange 203, stiffeners 204 in the webs 205, and folded sub-elements 206 in the top flange 207.

FIG. 12 shows a series of profile shapes 202 arranged and interlocked adjacent to one another in the same fashion discussed with respect to the structural element 86 with interior flange 89 and overlapping outer flanges 90, 91.

Figure 13:
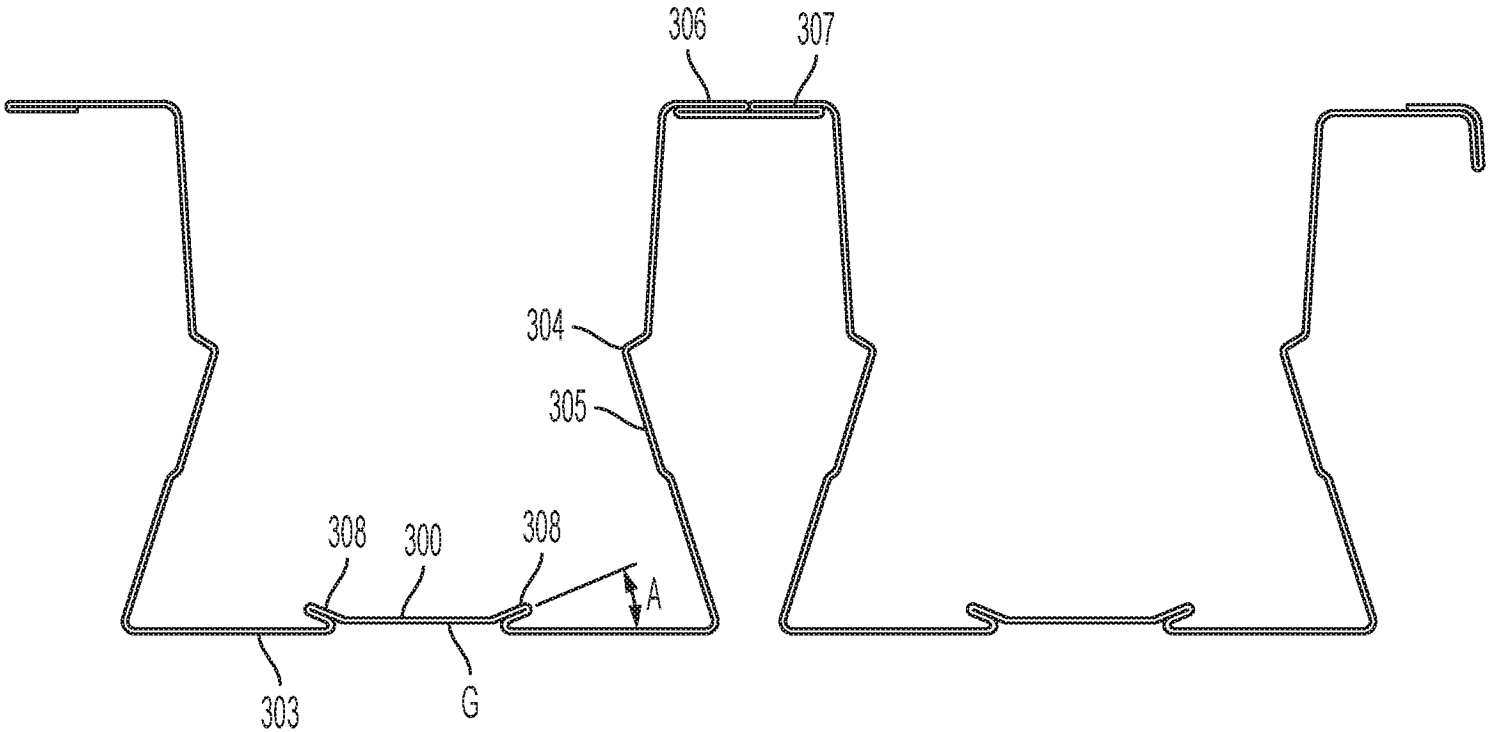
FIG. 13 is another embodiment side elevation view of the subject invention showing a structural member employing folded layers in bottom flanges similar to the embodiment shown in FIG. 11, but with folder layers having a winged portion angled from the remaining portion of the flange.

Another further alternate arrangement is shown in FIG. 13 which is similar to FIG. 11 except for folded section 300 has wings generated by the overlapping section bent in a direction at a non-zero angle with respect to the remaining flange.

The panel in FIG. 13 is made up of uniform thickness sheet metal having a repeating pattern of top flanges 307 and bottom flanges 303 connected by webs 305 therebetween. At least one flange 303 is comprised of a plurality of folded sub-elements 300 adjacent to each other in a stacked position to increase the thickness of the flange 303. The flange 303 is folded to make up multiple folds defining two separate spaced-apart switch-back configurations 308 with a gap G therebetween providing a portion of the flange with a three deep layer. Furthermore, in FIG. 13 two folds of each switch-back configuration 308 form an acute angle A relative to the remaining portion of the flange.

Figure 14:
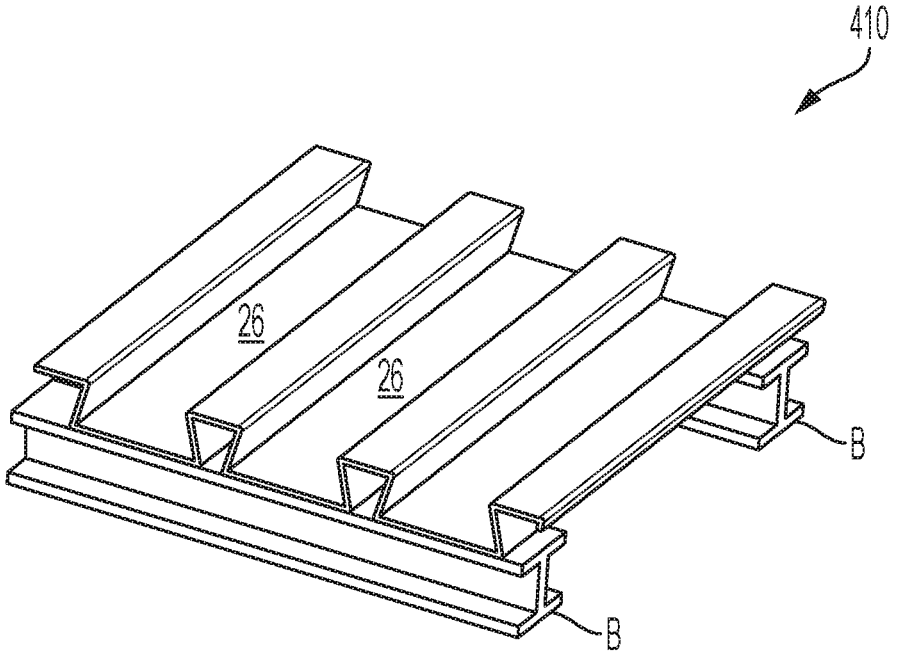
FIG. 14 is a side elevation of a deck panel with support members underneath.

While so far discussed have been individual panels, the construction of convention centers, arenas, office buildings, and other major structures normally uses multiple deck panels assembled in a side-by-side and/or end-to-end relationship to facilitate the construction of a structural deck. FIG. 14 show a typical deck panel 410 which is representative of the panels discussed herein. Typically, a plurality of these panels are connected together to form the structural deck supported by support structure B, which can be a purlin, beam, truss, or any supporting member or supporting wall, for example, extending transversely across each end of the panels as shown.

The subject invention is also directed to a method for forming decking comprising the steps of, beginning with a uniform thickness structural member, bending the member to provide a repeating pattern of top flanges and bottom flanges connected by webs therebetween, wherein at least one flange is comprised of a plurality of folded-layer segments adjacent to each other in a stacked position to increase the thickness of the flange.

Figure 15:
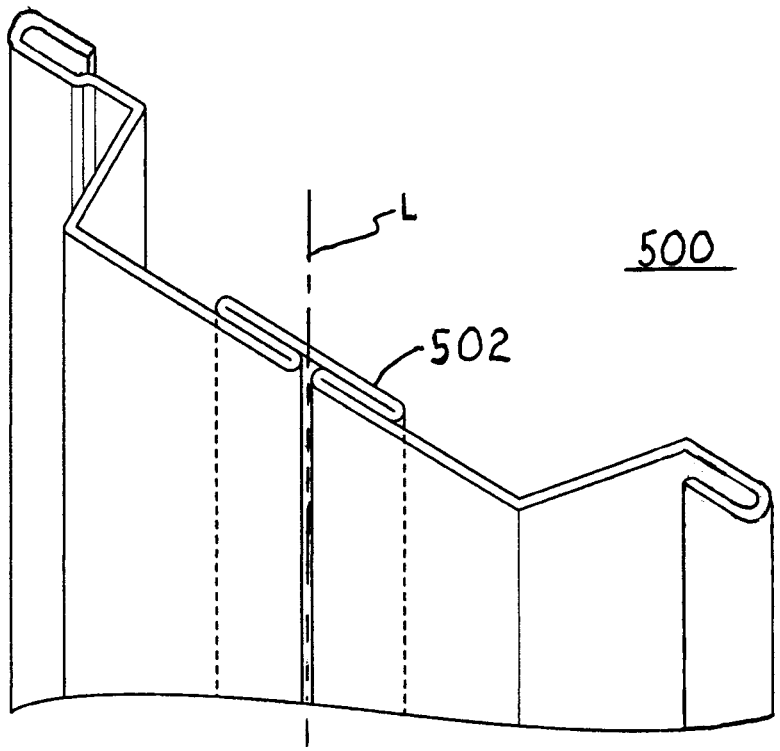
FIG. 15 is a perspective view of the subject invention showing a structural element such as a piling.

While so far discussed has been the application of folded sub-elements to decking, it should be appreciated that this concept may also be applied to other structural members. Directing attention to FIG. 15, a structural member 500 used as piling extends along a longitudinal axis L comprising a uniform thickness plate 502 folded back onto itself about the longitudinal axis L or an axis parallel to the longitudinal axis to provide greater resistance to buckling in response to compressive forces along the longitudinal axis L. Additionally, the subject invention is also direct to a method for forming piling comprising the step of beginning with a uniform thickness structural member extending along a longitudinal axis, bending the member onto itself about the longitudinal axis or an axis parallel to the longitudinal axis to provide greater resistance to buckling in response to compressive forces.

It should be appreciated that each of the embodiments discussed herein not only provides certain structural advantages but also does so while at the same time retaining a desired level of an aesthetic appearance. In particular, the decking is comprised of a panel of uniform thickness sheet metal having a repeating pattern of top flanges and bottom flanges connected by webs therebetween, wherein at least one flange is comprised of a plurality of folded-layer segments adjacent to each other in a stacked position to increase the thickness of the flange and wherein the sheet metal is a single folded sheet with minimum discontinuities thereby providing an aesthetically pleasing appearance.

It is to be understood that while certain embodiments and examples of the invention are illustrated herein, the invention is not limited to the specific embodiments or forms described and set forth herein. It will be apparent to those skilled in the art that various changes and substitutions may be made without departing from the scope or spirit of the invention and the invention is not considered to be limited to what is shown and described in the specification, embodiments, and examples that are set forth therein. Moreover, several details describing structures and processes that are well-known to those skilled in the art and often associated with roof decks, floor decks, or ceilings are not set forth in the following description to better focus on the various embodiments and novel features of the disclosure of the present invention. One skilled in the art would readily appreciate that such structures and processes are at least inherently in the invention and in the specific embodiments and examples set forth herein.

One skilled in the art will readily appreciate that the present invention is well adapted to carry out the objectives and obtain the ends and advantages mentioned herein as well as those that are inherent in the invention and in the specific embodiments and examples set forth herein. The embodiments, examples, methods, and compositions described or set forth herein are representative of certain preferred embodiments and are intended to be exemplary and not limitations on the scope of the invention. Those skilled in the art will understand that changes to the embodiments, examples, methods and uses set forth herein may be made that will still be encompassed within the scope and spirit of the invention. Indeed, various embodiments and modifications of the described compositions and methods herein which are obvious to those skilled in the art are intended to be within the scope of the invention disclosed herein. Moreover, although the embodiments of the present invention are described in reference to use in connection with roof decks, floor decks, and ceilings, one of ordinary skill in the art will understand that the principles of the present invention could be applied to other types of structural elements.

While the preferred embodiments of the inventions have been described herein, it is to be understood that the invention may be otherwise embodied with the scope of the following claims.

I claim:

1. A decking comprising a unitary panel of uniform thickness sheet metal with a top surface and a bottom surface having a repeating pattern of top flanges and bottom flanges connected by webs therebetween wherein each of the top flanges and the bottom flanges each has a maximum energy potential and a width and the width of at least one of the top flanges is less than the width of at least one of the bottom flanges, the at least one of the bottom flanges connected to the at least one of the top flanges by a web, wherein the at least one of the top flanges is comprised of a plurality of folded-layer segments which are folded back onto itself to contact itself and adjacent to each other in a parallel stacked position, such that the maximum energy potential of the at least one of the top flanges comprised of a plurality of folded-layer segments is equal in magnitude to the maximum energy potential of the at least one of the bottom flanges without a plurality of folded-layer segments that is connected to the at least one of the top flanges by a web.

2. The decking in accordance with claim 1, wherein the top flanges and the bottom flanges are parallel to one another.

3. The decking in accordance with claim 1, wherein the panel comprises:

a) a series of adjacent top flanges of the pattern of top flanges and a series of adjacent bottom flanges of the pattern of bottom flanges;

b) wherein each top flange has a first and second end and each bottom flange has a first and second end;

c) wherein the first end of one bottom flange is connected to the second end of one top flange and the second end of the bottom flange is connected to the first end of a different top flange.

4. The decking in accordance with claim 3, wherein at least one flange is folded from each end to make up multiple folds defining two separate spaced-apart switch-back configurations with a gap therebetween providing a three deep layer flange.

5. The decking in accordance with claim 4, wherein the gap is facing outwardly from a cavity defined by the flange and adjacent webs.

6. The decking in accordance with claim 4, wherein the gap is facing inwardly from a cavity defined by the flange and adjacent webs.

7. The decking in accordance with claim 3, wherein each flange has a width equal to a spacing of the webs.

8. The decking in accordance with claim 3, wherein each flange is folded from each flange end to make up a single switch-back configuration providing a three deep layer flange.

9. The decking in accordance with claim 8, wherein each layer is parallel to the other layer over the entire width of the flange.

10. The decking in accordance with claim 3, wherein an outermost portion of the flanges has double-folded elements on one side of the flange and another of the outermost flanges has double folded elements on an opposite side of the flange such that the opposing sides of two identical panels may be interlockably mated with one another.

11. The decking according to claim 1, wherein a juncture where the web and flange meet is symmetrical about a vertical axis between adjacent webs.

12. The decking according to claim 1, where the folded layer segments are symmetrical about a vertical axis.

13. A structural member extending along a longitudinal axis comprising a uniform thickness plate with a top surface and a bottom surface, having a series of top flanges and a series of bottom flanges; wherein the series of top flanges includes flanges having a width and a maximum energy potential and the series of bottom flanges includes flanges having a width and a maximum energy potential, wherein at least one of the flanges being folded back to contact itself to make up multiple folds directed onto one another defining a switch-back configuration about an axis parallel to the longitudinal axis to provide greater resistance to buckling in response to compressive forces, wherein each top flange has a first end and a second end and each bottom flange has a first end and a second end, the first end of one bottom flange is directly connected by a sidewall or web to the second end of one top flange and the second end of the bottom flange is directly connected by a sidewall or a web to the first end of a different top flange, wherein the width of the flanges of the bottom flange is greater than the width of the flanges of the top flange, and wherein the maximum energy potential of the at least one of the flanges being folded back to contact itself to make up multiple folds is equal in magnitude to the maximum energy potential of at least one of the flanges without multiple folds to which it is directly connected by a sidewall or a web.

14. A decking comprising a panel of uniform thickness sheet metal having a repeating pattern of top flanges and bottom flanges, the top flanges and bottom flanges each having a width and a maximum energy potential, the top flanges and bottom flanges connected by webs or sidewalls therebetween, wherein each top flange has a first end and a second end and each bottom flange has a first end and a second end, and the first end of one bottom flange is directly connected by a sidewall or a web to the second end of one top flange and the second end of the bottom flange is directly connected by a sidewall or a web to the first end of a different top flange, wherein at least one flange is comprised of multiple folds defining two separate spaced-apart switch-back configurations with a gap therebetween, the two separate spaced-apart switch-back configurations defining at least a three deep layer flange in a stacked position with an increased thickness and shorter width compared to at least one of the flanges to which it is directly connected by a sidewall or a web such that the maximum energy potential of the flange comprised of multiple folds is equal in magnitude to the maximum energy potential of the at least one of the flanges without multiple folds to which it is directly connected by a sidewall or a web, wherein the sheet metal is a single folded sheet with minimum discontinuities thereby providing an aesthetically pleasing appearance.

* * * * *